US006820995B2

(12) United States Patent
Lin

(10) Patent No.: US 6,820,995 B2
(45) Date of Patent: Nov. 23, 2004

(54) SUNSHADE DEVICE

(76) Inventor: Chen-Hsiung Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/395,440

(22) Filed: Mar. 21, 2003

(65) Prior Publication Data

US 2004/0184261 A1 Sep. 23, 2004

(51) Int. Cl.[7] ..... A45B 3/02; F21L 4/02

(52) U.S. Cl. ..... 362/102; 362/183; 362/276; 135/910

(58) Field of Search ..... 362/102, 183, 362/234, 276, 802; 135/16, 910

(56) References Cited

U.S. PATENT DOCUMENTS 2,507,919 A * 5/1950 Mazzeo ..... 362/102
5,053,931 A * 10/1991 Rushing ..... 362/102
5,954,417 A * 9/1999 Mai ..... 362/102
6,135,605 A * 10/2000 Hsu et al. ..... 362/102
6,612,713 B1 * 9/2003 Kuelbs ..... 362/102
2003/0000559 A1 * 1/2003 Wu ..... 135/16

* cited by examiner

*Primary Examiner*—Alan Cariaso

(57) ABSTRACT

A sunshade device has a main shaft, a runner, an inner cap, a sensor socket, a plurality of stretchers, a plurality of ribs, a plurality of illuminating devices disposed on the ribs, and a sunshade panel disposed on the stretchers. The main shaft passes through the runner, the inner cap, and the sunshade panel. The sensor socket is disposed on the main shaft. The ribs are connected to the top end of the main shaft. Each of the stretchers is connected to the runner and the corresponding rib. A solar energy sensor is disposed on the sensor socket. An electric wire is connected to the solar energy sensor and the illuminating devices.

4 Claims, 4 Drawing Sheets

SUNSHADE DEVICE

BACKGROUND OF THE INVENTION

The present invention relates to a sunshade device.

More particularly, the present invention relates to a sunshade device which has a solar energy sensor and a plurality of illuminating devices.

A conventional sunshade device is often used as a sunscreen device for a user in the daytime. However, the conventional sunshade device cannot be used at night. Since the conventional sunshade device cannot illuminate light, the user will not pay attention to the conventional sunshade device at night.

SUMMARY OF THE INVENTION

An object of the present invention is to provide a sunshade device which has a plurality of illuminating devices and a micromotion switch and a flashing circuit board to control a flashlight of each illuminating device.

Another object of the present invention is to provide a sunshade device which has a solar energy sensor to recharge an electric source in the daytime in order to save an electric energy for a plurality of illuminating devices to illuminate light at night.

Accordingly, a sunshade device comprises a main shaft, a runner, an inner cap, a sensor socket, a plurality of stretchers, a plurality of ribs, a plurality of illuminating devices disposed on the ribs, and a sunshade panel disposed on the stretchers. The main shaft passes through the runner, the inner cap, and the sunshade panel. The sensor socket is disposed on the main shaft. The ribs are connected to the top end of the main shaft. Each of the stretchers is connected to the runner and the corresponding rib. A solar energy sensor is disposed on the sensor socket. An electric wire is connected to the solar energy sensor and the illuminating devices.

DETAILED DESCRIPTION OF THE INVENTION

Figure 1:
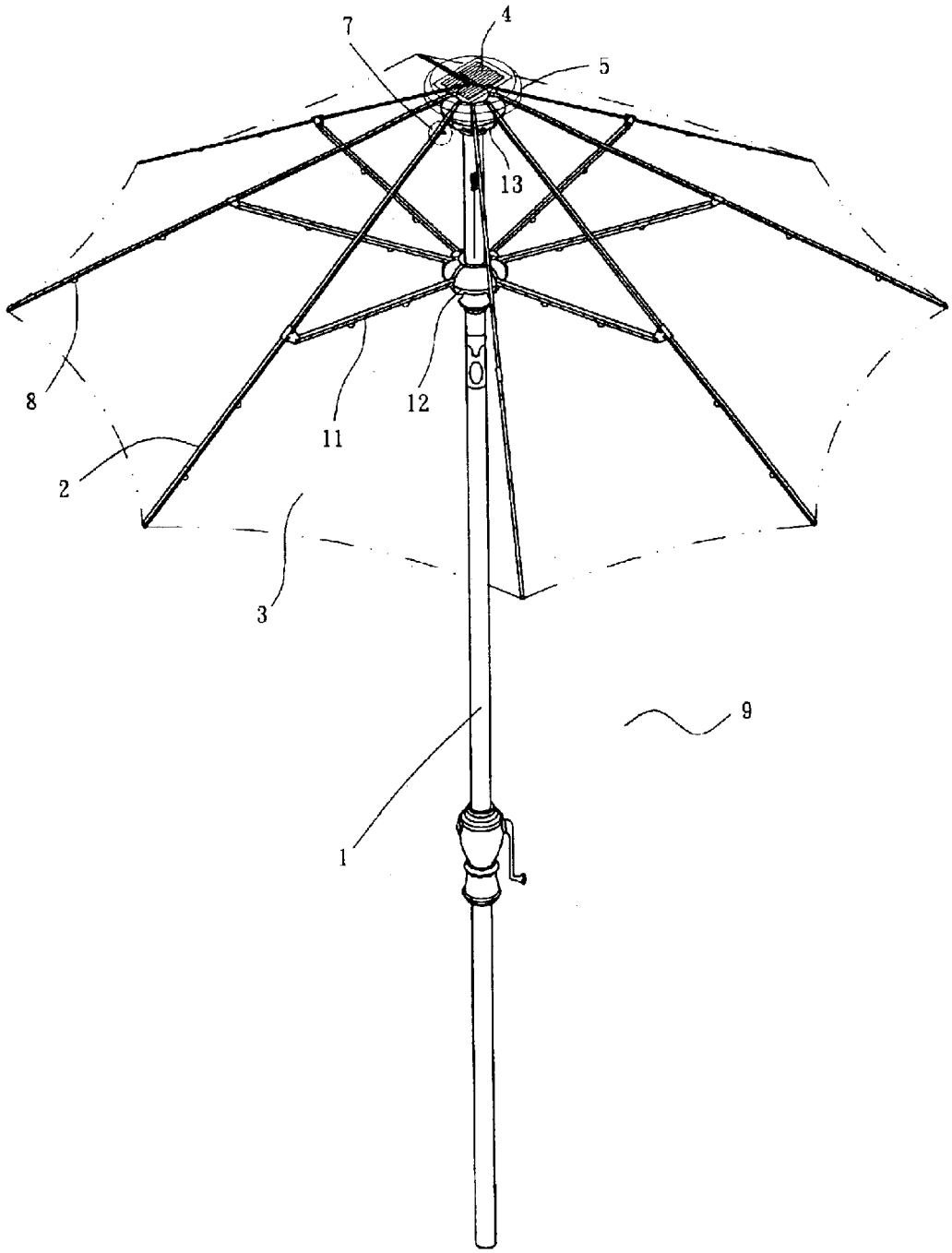
FIG. 1 is a perspective view of a sunshade device of a preferred embodiment in accordance with the present invention.
Figure 2:
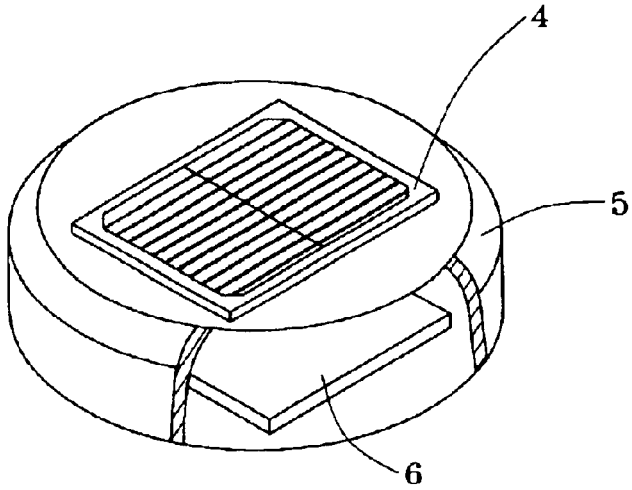
FIG. 2 is a perspective assembly view of a sensor socket, a solar energy sensor and a flashing circuit board of a preferred embodiment in accordance with the present invention.
Figure 3:
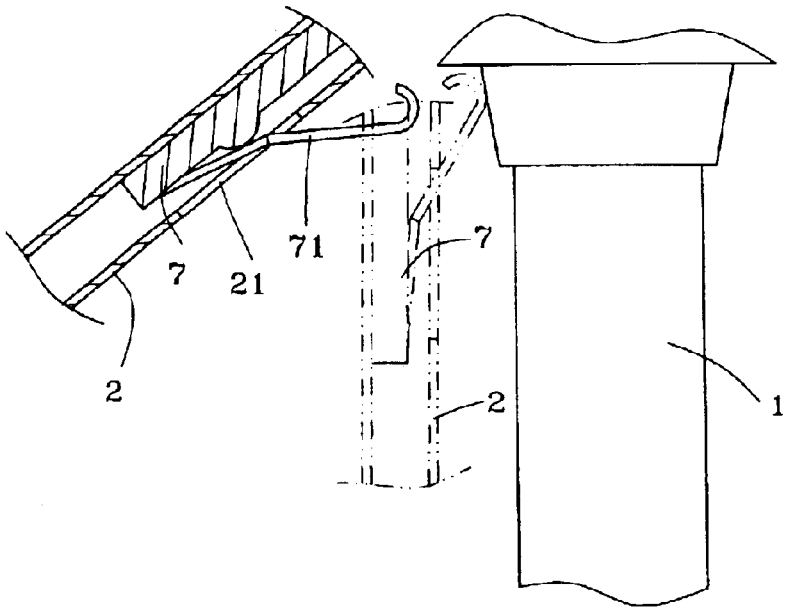
FIG. 3 is a schematic view illustrating an operation of a micromotion switch of a preferred embodiment in accordance with the present invention.
Figure 4:
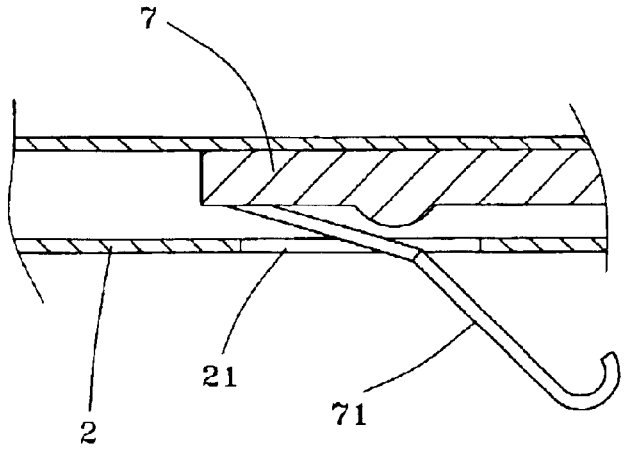
FIG. 4 is a sectional assembly view of a rib and a micromotion switch of a preferred embodiment in accordance with the present invention.
Figure 5:
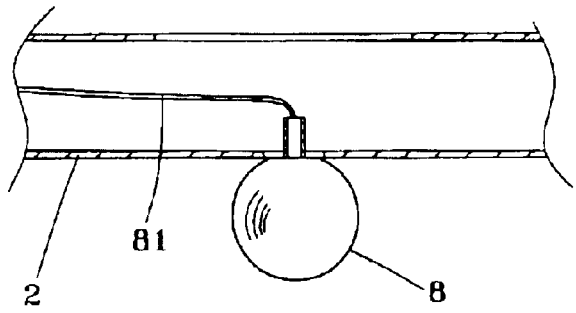
FIG. 5 is a sectional assembly view of a rib and an illuminating device of a preferred embodiment in accordance with the present invention.
Figure 6:
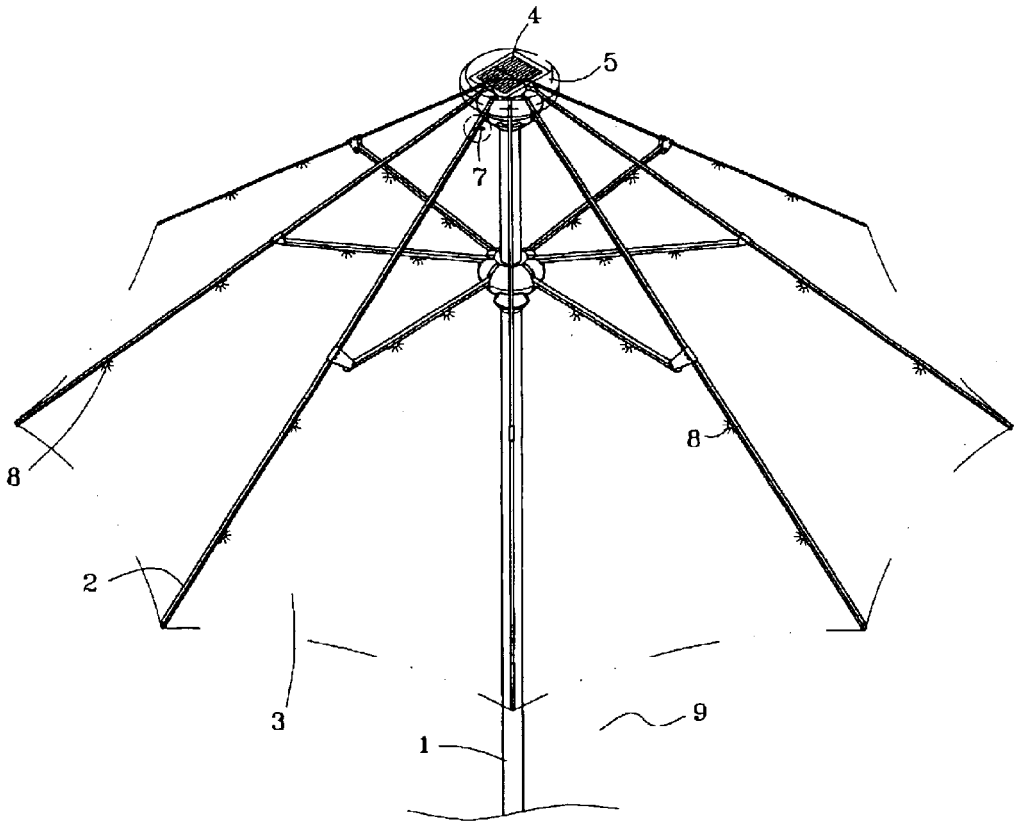
FIG. 6 is a schematic view illustrating an operation of a plurality of illuminating devices of a preferred embodiment in accordance with the present invention.

Referring to FIGS. 1 to 6, a sunshade device 9 comprises: a main shaft 1, a runner 12, an inner cap 13, a sensor socket 5, a plurality of stretchers 11, a plurality of ribs 2, a plurality of illuminating devices 8 disposed on the ribs 2, and a sunshade panel 3 disposed on the ribs 2.

The main shaft 1 passes through the runner 12 and the inner cap.

The sensor socket 5 is disposed on a top end of the main shaft 1.

The ribs 2 are connected to the top end of the main shaft 1.

Each of the stretchers 11 is connected to the runner 12 and the corresponding rib 2.

A solar energy sensor 4 is disposed on the sensor socket 5.

An electric wire 81 is connected to the illuminating devices 8 and the solar energy sensor 4 (not shown in the figures).

A flashing circuit board 6 is disposed in the sensor socket 5.

A micromotion switch 7 is disposed on one of the ribs 2 having a hole 21.

A control handle 71 is inserted through the hole 21 of the rib 2 to be connected to the micromotion switch 7.

The solar energy sensor 4, the flashing circuit board 6 and the micromotion switch 7 are connected electrically.

The solar energy sensor 4 provides an electric source.

Each of the illuminating devices 8 is made of a light-emitting diode.

The sensor socket 5 has a disk shape.

Referring to FIG. 1 again, the sunshade device 9 is extended in the daytime so that the solar energy sensor 4 will recharge the electric source.

Referring to FIG. 6 again, the sunshade device 9 is extended at night and the micromotion switch 7 is turned on so that the illuminating devices 8 will illuminate light.

When the sunshade device 9 is folded, the micromotion switch 7 will be turned off.

The present invention has the following advantages. The micromotion switch and the flashing circuit board will control a flashlight of each illuminating device. The solar energy sensor will recharge the electric source in the daytime in order to store an electric energy for a plurality of illuminating devices to illuminate light at night.

The present invention is not limited to the above embodiments but various modification thereof may be made. Furthermore, various changes in form and detail may be made without departing from the scope of the present invention.

I claim:

1. A sunshade device comprises:

a main shaft, a runner, an inner cap, a sensor socket, a plurality of stretchers, a plurality of ribs, a plurality of illuminating devices disposed on the ribs, and a sunshade panel disposed on the ribs, the main shaft passing through the runner and the inner cap, the sensor socket disposed on the main shaft, the ribs connected to atop end of the main shaft, each of the stretchers connected to the runner and the corresponding rib, a solar energy sensor disposed on the sensor socket, an electric wire connected to the solar energy sensor and the illuminating devices, a flashing circuit board disposed in the sensor socket, a micromotion switch disposed on one of the ribs having a hole, a control handle inserted through the hole of the rib and connected to the micromotion switch, and the solar energy sensor, the flashing circuit board and the micromotion switch being connected electrically.

2. The sunshade device as claimed in claim 1, wherein each of the illuminating devices is made of a light emitting diode.

3. The sunshade device as claimed in claim 1, wherein the sensor socket has a disk shape.

4. The sunshade device as claimed in claim 1, wherein the sensor socket is disposed on the top end of the main shaft.

* * * * *